US009927080B2

(12) United States Patent
Dahlen et al.

(10) Patent No.: US 9,927,080 B2
(45) Date of Patent: Mar. 27, 2018

(54) OPTIC PANEL, LED LIGHTING SYSTEM, AND LUMINAIRE

(71) Applicant: KENALL MANUFACTURING COMPANY, Kenosha, WI (US)

(72) Inventors: Kevin Dahlen, Lindenhurst, IL (US); Steven Akiyama, New Lenox, IL (US); Megan Tidd, Arvada, CO (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 294 days.

(21) Appl. No.: 14/850,290

(22) Filed: Sep. 10, 2015

(65) Prior Publication Data

US 2017/0075059 A1 Mar. 16, 2017

(51) Int. Cl.
*F21S 8/04* (2006.01)
*F21Y 101/02* (2006.01)

(52) U.S. Cl.
CPC ..... *F21S 8/043* (2013.01); *F21Y 2101/02* (2013.01)

(58) Field of Classification Search
CPC ..... G02B 6/0096; F21S 8/043
See application file for complete search history.

(56) References Cited

U.S. PATENT DOCUMENTS

2014/0268764 A1 9/2014 Stolte et al.
2015/0159852 A1 6/2015 Dahlen et al.
2015/0163884 A1 6/2015 Dahlen

OTHER PUBLICATIONS

Luxtran, Luminaires for Tunnel Applications, LTSIU Series, (copyright 2014), product specification sheet available at www.kenall.com <http://www.kenall.com>.

*Primary Examiner* — Elmito Breval
(74) *Attorney, Agent, or Firm* — Marshall, Gerstein & Borun LLP

(57) ABSTRACT

An optic panel, an LED lighting system including the optic panel, and a luminaire including the LED lighting system are described. The optic panel includes an optic disposed within a cut out of a base plate, and one or more supports fixedly couple the optic with the base plate. Each support preferably touches the optic at only a single location. In some aspects, the supports provide sufficient support to the optic such that the entire optic panel can be molded as a single, monolithic mass and the supports do not or only minimally interfere with the desired total internal reflection of the optics because of the minimal engagement with the supports and/or the placement of the engagement with the supports. The optic panel may be incorporated into the LED lighting system, for example, forming a secondary optics for the LED lighting system.

20 Claims, 4 Drawing Sheets

OPTIC PANEL, LED LIGHTING SYSTEM, AND LUMINAIRE

FIELD

This application relates generally to an optics arrangement that may be suitable for an LED lighting system for a luminaire, and, more particularly, for an optics arrangement in the form of an optic panel.

BACKGROUND

A luminaire is generally understood to include one or more light producing subsystems carried by a housing along with power, driving, and/or power distribution devices. In this manner, the luminaire provides a single unit that is easy to install and/or ship. An example of a luminaire is a light fixture, such as a hanging light fixture commonly installed to hang from a ceiling or wall. However, there are many different types of luminaires, and the luminaires discussed herein are to be considered representative of all such devices.

Lighting installations for illuminating driving surfaces, such as road ways and parking lots, often utilize one or more luminaires for providing the desired illumination. Some basic concerns when so used is providing light at an angle that provides the desired illumination of the driving surface while at the same time minimizing or eliminating glare of direct light into the eyes of drivers. In order to accomplish this, it is customary to adjust the luminaires such that light emitted from a luminaire is focused along a particular focus pattern and/or angle to provide the desired illumination without being directed directly into the eyes of a driver driving a typical automobile on the driving surface.

The use of light emitting diode (LED) based lighting systems for luminaires is more and more commonplace due to their energy efficiency and life span. LEDs generate an intense point of light, which is generally anisotropic and has a narrow incident beam. The directionality of the light emitted by the LEDs can cause excessive and/or undesirable glare, which can make LEDs very bright and harsh to look at. As pointed out above, such glare can be of particular concern when used for lighting a driving surface. Thus, although desirable for efficiency, the use of LEDs for illuminating driving surfaces, and in particular streets and highways, could be problematic unless proper glare-reducing measures are taken.

An ideal design of an LED lighting system in a luminaire for driving surfaces provides sufficient illumination levels on the ground while creating the effect of minimal light at the LEDs. To help achieve this objective, many LED manufacturers place a primary optic (e.g., a lens) over the semi-conductor element of each LED to create a lambertian light distribution pattern. While this light distribution pattern reduces glare to some degree, roadway lighting often requires an even greater amount of glare reduction. In these cases, it is customary to place a secondary optic (e.g., a lens) over each of the LEDs (as well as the primary optic) to further focus and/or distribute the light in a desired manner. Additional measures, such as adding tertiary optics in the form of additional lenses and/or diffusers is also common, depending on the specific needs of the lighting installation. Adding the secondary optic, as opposed to simply modifying the primary optic, is preferred because the primary optic is typically installed by the manufacturer of the LED and is closely integrated with the semi-conductor element of the LED. The secondary optic, which is typically manufactured separately from the LED/primary optic element, can then be placed over the LED/primary optic relatively easily at a later time.

Typical secondary optics are manufactured by molding an optics material, such as glass or polycarbonate, into one or more secondary optics carried by a base. Molding is a relatively efficient way to manufacture the secondary optic, in particular when several separate optics are carried by a single base. In this manner, a secondary optic may be in the form of a panel having several individual optics carried by a base, wherein a single panel may be used to fix several individual optics over a corresponding number of individual LEDs (and the corresponding primary optics).

When manufactured by such molding methods, however, it may be difficult to mold the desired size and/or shape of the individual optics as a single, integral mass along with the base due to manufacturing constraints. Thus, it may not be possible to obtain the desired size and/or shape of the optics in such a molding operation, in particular where the optic has a relatively complex shape. However, the desired light focusing properties needed for reducing glare in the LED lighting systems for luminaires used for illuminating driving surfaces often have a relatively complex shape. Thus, it would be beneficial to have an optic panel that is both easy to manufacture by molding and provides the light focusing properties desired for illuminating driving surfaces.

SUMMARY

According to some aspects of the disclosure, an optic panel is provided, which addresses one or more of these concerns. In some arrangement, an optic is disposed within a cut out of a base plate, and one or more supports fixedly couples the optic with the base plate. Each support preferably touches the optic at only a single location. In some aspects, the supports provide sufficient support to the optic such that the entire optic panel can be molded as a single, integral mass, and the supports do not (or only minimally) interfere with the desired total internal reflection of the optics because of the minimal engagement with the supports and/or the placement of the engagement with the supports.

According to some aspects of the disclosure, an LED lighting system is provided that incorporates an optic panel of the disclosure. In some arrangements, an optic panel according to the disclosure forms a secondary optic to cover a primary optic coupled to a light-emitting diode. In this way, the LED lighting system can be provided with secondary optics that can provide complex optics designs with the advantage of being able to be easily produced, for example, by relatively simple molding techniques.

According to some aspects of the disclosure, a luminaire is provided that incorporates an optic panel of the disclosure. In some arrangements, an optic panel according to the disclosure forms a secondary optic for an LED lighting system carried by a housing along with a driver to drive the LED lighting system. In this way, a luminaire can be provided with highly specialized optics systems for providing a desired illumination and minimizing unwanted glare with a relatively complex secondary optic that is relatively easy to manufacture, for example, by common simple molding techniques.

Additional aspects, arrangements, features, and/or technical effects will become apparent upon detailed inspection of the figures and the detailed description.

DETAILED DESCRIPTION

Figure 1:
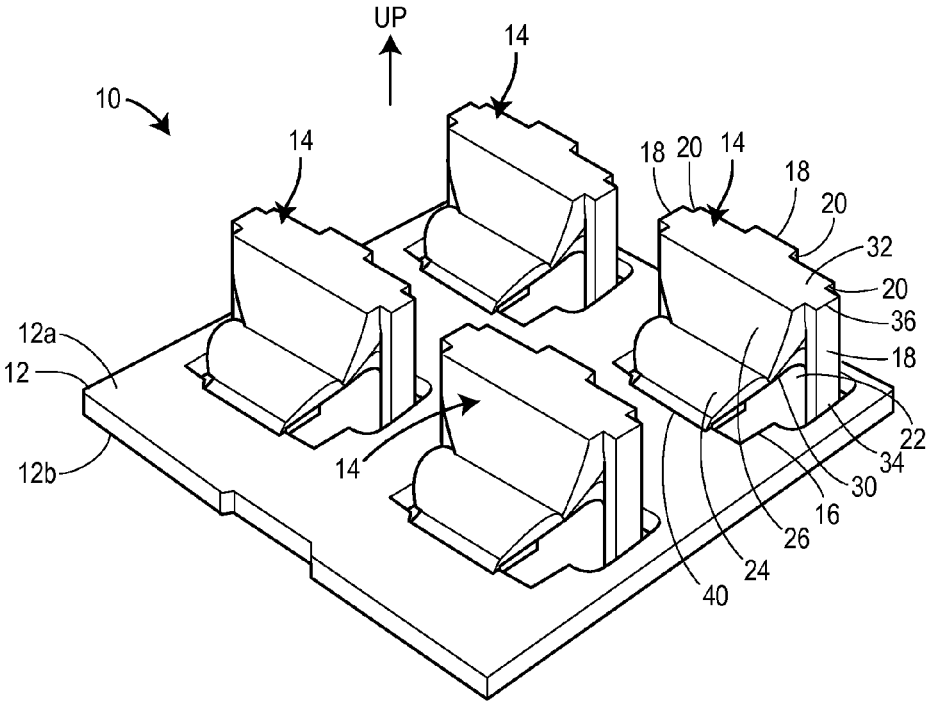
FIG. 1 is an isometric view of an optic panel according to one exemplary arrangement of the present invention.

Before describing the specific examples of the drawings, some general aspects, arrangements, and features of the disclosed optic panel, LED lighting system, and/or luminaires are provided.

In some arrangements, an optic panel is disclosed that includes a base plate having a cutout, an optic disposed in the cutout and coupled to the base plate, and a plurality of supports that fixedly support the optic from the base plate. The optic may include a collector and a light pipe extending upwardly from the collector, wherein the light pipe has a distal end spaced from the collector, and light collected by the collector is focused outwardly along an axis by the light pipe. The collector may be disposed on or adjacent to the base plate, and/or the light pipe may extend upwardly above the base plate. Each support may extend upwardly from the base plate to the light pipe to fix the optic to the base plate. In this way, the supports can support and/or stabilize the light pipe in its upwardly extending position above the base plate. Each support preferably engages the light pipe at only a single contact point, and a gap is disposed between the support and all other portions of the optic. In this way, the supports can support the optic, for example by preventing warping of the light pipe while cooling after being molded, without engaging the boundaries of the light pipe in a way that would substantially interfere with the desired total internal reflection properties of the light pipe. The optic panel may include any one or more additional aspects, arrangements, and/or features disclosed herein.

In some arrangements, an LED lighting system is disclosed that includes a light emitting diode, a primary optic coupled to the light emitting diode to receive and transmit light from the light emitting diode, and a secondary optic panel having a secondary optic that covers the primary optic to receive light transmitted from the primary optic and transmit the light. The secondary optic panel includes an optic panel according to any one or more of the aspects, arrangements, and/or features disclosed herein.

In some arrangements, a luminaire is disclosed that includes a housing, an LED lighting system carried by the housing, and a driver to drive the LED lighting system from an electrical power source. The LED lighting system preferably includes a light emitting diode, a primary optic coupled to the light emitting diode to receive and transmit light from the light emitting diode, and a secondary optic panel having a secondary optic that covers the primary optic to receive light transmitted from the primary optic and transmit the light. The secondary optic panel includes an optic panel according to any one or more of the aspects, arrangements, and/or features disclosed herein.

While specific exemplary forms are illustrated and described herein, is to be understood that any of the various aspects, arrangements, and/or features disclosed herein may be combined with any one or more of the other aspects, arrangements, and/or features disclosed herein.

The optic may have a generally "whistle-shaped" shape. For example, the collector may have a generally cylindrical shaped body having an axis that is parallel with the plane of the base plate, and the light pipe may extend upwardly from the collector, for example having a proximal end connected to and tangentially extending from the generally cylindrical shaped body of the collector and a distal end spaced upwardly above the body of the collector. The collector may be disposed on or within the plane of the base plate, and the light pipe may extend upwardly above the base plate. The collector may include a receiver for receiving an LED. The receiver may be in the form of a recess, such as a hemispherical or spherical section, located in a bottom surface of the collector. Left and/or right sides of the light pipe and the collector may be tapered inwardly from the distal end of the light pipe to the bottom surface of the collector so as to focus, direct, and/or collimate light received in the receiver outwardly through the distal end of the light pipe. The left and/or right sides of the light pipe and the collector may be tapered along a curve, such as a portion of a parabolic curve. A front side of the light pipe may extend upwardly from an intersection with the outer surface of the collector. The front side of the light pipe may be flat (i.e., planar), and may optionally extend upwardly perpendicular to the plane of the base plate. A backside of the light pipe may also be tapered inwardly from the distal end of the light pipe to the proximal end of the light pipe, for example, along a curve, such as a portion of a parabolic curve. Preferably, the distal end of the light pipe forms a flat surface perpendicular to an axis of the light pipe. Light from an LED disposed within the receiver may be guided within the collector and the light pipe by total internal reflection to exit the distal end of the light pipe. It may be possible to obtain the desired focusing and/or transmission of light without providing any additional reflective material disposed on the optic. Optionally, the light pipe may be a collimator that culminates the light exiting the distal end of the light pipe.

The single contact point of the support with the optic may be located at the distal end of the light pipe. The bottom end of the support may be coupled to the base plate, and the top end may be coupled to the distal end of the light pipe. All of the remaining portions of the support are spaced apart from any other portion of the optic. The optic may taper inwardly from the distal end of the light pipe toward the collector as explained above, and a gap may be disposed between each support and the light pipe below the single point of contact. In this way, internally reflected light within the light pipe is not able to pass into the supports at any location except at the single point of contact. Further, the contact point between the support and the light pipe may be disposed at only the distal end surface of the light pipe where light exits the light pipe, which thereby minimizes any deleterious effects of the coupling of the surfaces of the support and the light pipe on the desired light guiding effects of total internal reflection through the light pipe.

One or more of the supports may be in the form of a tower having a bottom end and a top end. The tower may be, for example, in the shape of a column extending between the bottom end and the top end. Optionally, the tower may be in the form of a solid cylindrical section, such as a solid rectangular cylinder, or the column may be not cylindrical, but rather may taper from a narrower cross-section at the top end to a larger cross-section at the bottom end or vice versa. The towers may be vertical, in other words, having a longitudinal axis extending perpendicular to the plane of the optic panel. In some arrangements, one or more of the towers may be and/or have one or more surfaces disposed at an angle to the vertical. For example, the towers may angle inwardly toward the optic from the bottom end to the top end.

The cut out may encompass the downward projection of its respective optic. In other words, the downwardly projected footprint of the optic, which may be along an axis perpendicular to the plane of the base plate, is disposed entirely within the inner peripheral edges of the cutout. In some arrangements, the downward projection of one or more, and preferably all of the supports for a given optic are also encompassed within the cutout. Preferably, none of the surfaces of the optic, the supports, and the base plate are shaped with an undercut that would prevent molding of the surface with a common two-part, two-stroke molding apparatus. In this manner, manufacturer of the optic, the supports, and the base as a single, monolithic mass in a relatively simple two-part mold is simplified.

The base plate, the optic, and the supports may be formed of a unitary piece of material. The material may be any material that, in the form of a solid, is suitable for transmitting and/or focusing light, such as glass and translucent and/or transparent plastics. Preferably, the optic panel may be formed of polycarbonate. However, any one or more of the base plate, the optic, and the supports may be formed as separate parts and then subsequently assembled with the other parts, and still provide at least some of the benefits discussed herein.

The base plate may include a plurality of the said cutouts and a corresponding plurality of the said optics. One of the optics may be disposed in a corresponding one of each of the cutouts, and each of the optics may be fixed to the base by a corresponding plurality of the supports, as is described herein. The optics and the corresponding cutouts may be arranged across the base plate in a regular array, such as a rectangular array, or in an irregular array, for example depending upon the form of array of LEDs that the optic panel is intended to cover. In this manner, a single optic panel may provide individual optics for a plurality of LEDs, for example, disposed in a generally planar array. Thus, an optic panel according to this disclosure may be adapted to provide a desired optic for a single LED up to almost an unlimited number of LEDs with a panel that is formed by relatively simple molding techniques as a unitary monolithic mass. As a result, an optic panel according to this disclosure may in some arrangements provide a more efficient way to provide specialized optics for an array of many individual LEDs.

Turning now to the exemplary arrangements of the drawings, FIGS. 1-7 illustrate an optic panel 10 exemplifying various aspects of the disclosure. The optic panel 10 includes a base plate 12 and one or more optics 14 (in this example, four optics 14) coupled to the base plate 12. One or more cutouts 16 through the base plate 12, corresponding to the number of optics 14, form openings through the base plate 12. Each optic 14 is disposed within and/or above a corresponding one of the cutouts 16, which allows a mold part to extend through the base plate 12 to form the bottom surface of the optic 14 during a common two-part molding operation. Further, each optic 14 is fixedly coupled to the base plate 12 by at least one, and preferably a plurality of supports 18, such as by three such supports 18*a*, 18*b*, and 18*c*. Each support 18 extends upwardly from the base plate 12 to the respective optic 14 and engages the optic at only a single contact point 20. Thus, a gap 22 is formed and disposed between the support 18 and all of the remaining portions of the optic 14 below the contact point 20. Thus, when the optic panel 10 is formed, for example by a hot molding technique, the supports 18 help maintain the desired shape of the optic 14 while the material cools while simultaneously minimizing and/or eliminating any unwanted disturbances of total internal reflection surfaces along the optic 14. It is noted that, although the exemplary arrangement shown in FIGS. 1-7 illustrate an optic panel 10 with four individual optics 14 arranged in a rectangular array, the optic panel 10 could include fewer or more optics 14 and is not limited to the exact number and/or array configuration shown in the drawings.

Figure 2:
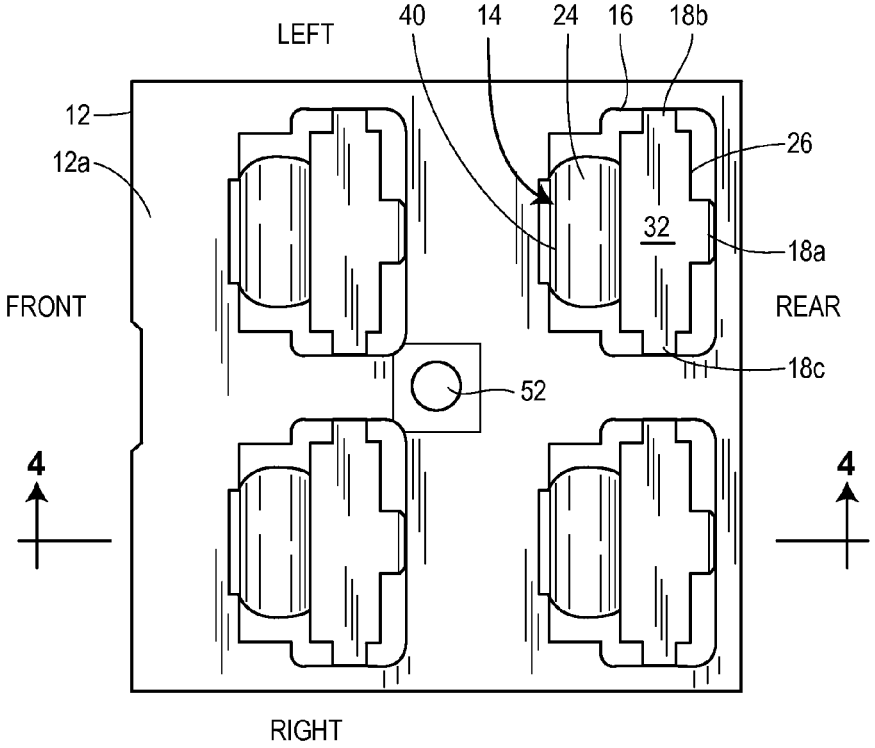
FIG. 2 is a top plan view of the optic panel of FIG. 1.
Figure 3:
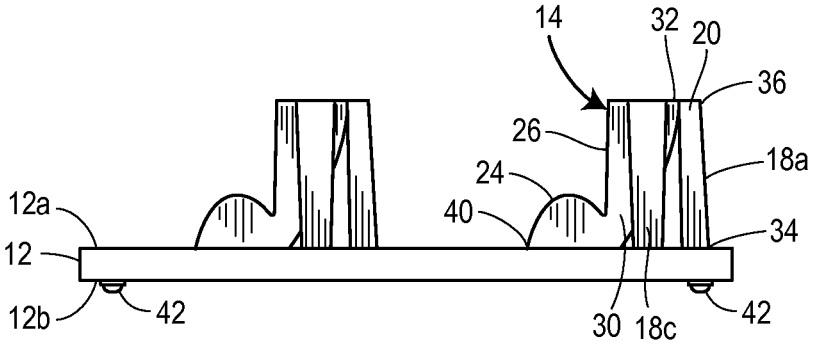
FIG. 3 is a right side elevation view of the optic panel of FIG. 1, the left side elevation view being a mirror image thereof.
Figure 4:
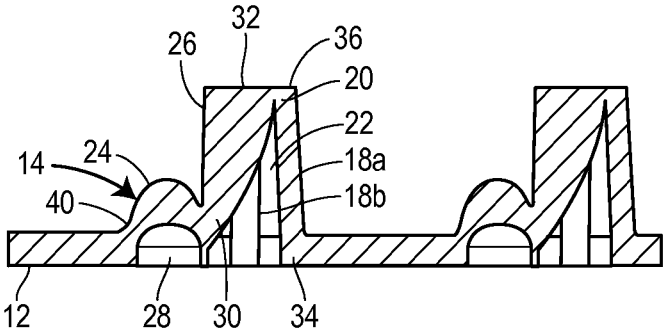
FIG. 4 is a cross-sectional view of the optic panel along the lines 4-4 of FIG. 2.
Figure 5:
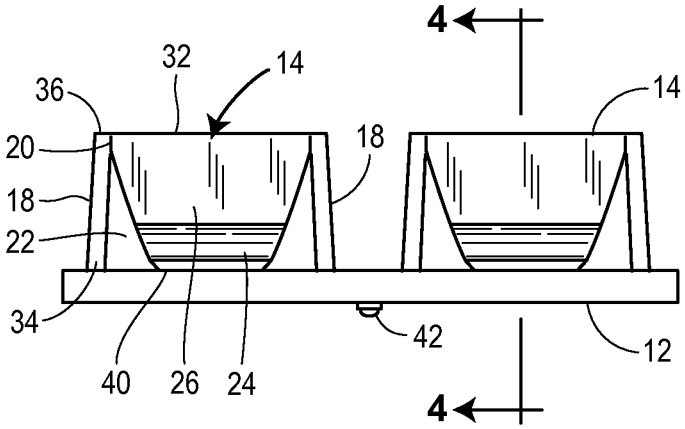
FIG. 5 is a front side elevation view of the optic panel of FIG. 1.
Figure 6:
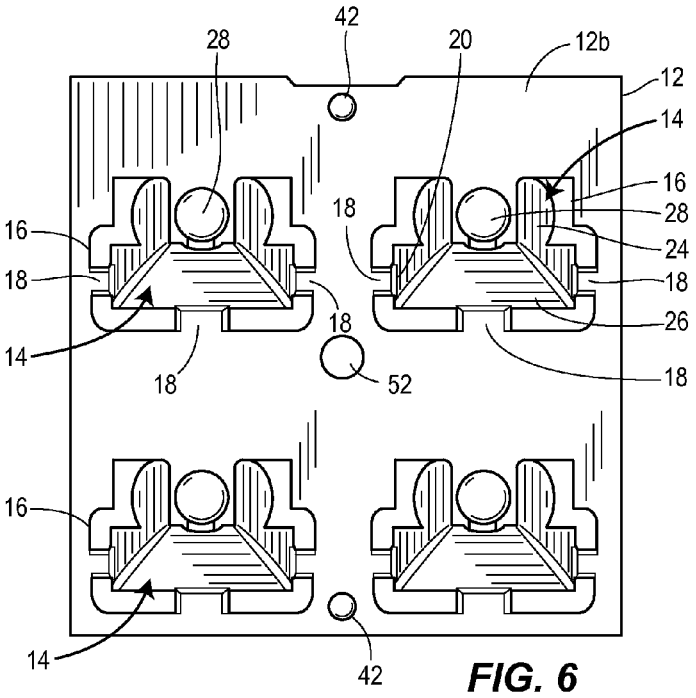
FIG. 6 is a bottom plan view of the optic panel of FIG. 1.
Figure 7:
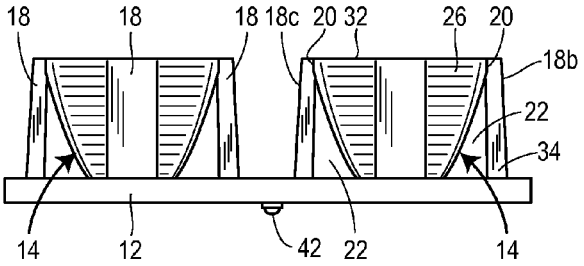
FIG. 7 is a rear side elevation view of the optic panel of FIG. 1.

The base plate 12 in the exemplary arrangement is in the form of a flat, planar plate having a relatively thin thickness dimension relative to a length and width dimension. However, the base plate 12 need not be planar or have the exact shape as shown in the drawings. Rather, the base plate 12 may be any shape appropriate for supporting one or more of the optics 14 over one or more LEDs of an LED lighting system. Solely for purposes of ease of description with respect to the drawings, the terms "up" and "down" and other similar directional terms are used with reference to the base plate 12 being arranged in a substantially horizontal orientation such that a top side 12*a* of the base plate 12, which is visible in FIGS. 1 and 2, is in the direction of "up," and a bottom side 12*b* of the base plate 12, which is visible in FIG. 6, is in the direction of "down," for example. However, it is understood that the optic panel 10 may be used in any orientation and is not limited to having the top side of the base plate 12 always directed in a global upward direction.

The optic 14 in this exemplary arrangement includes a first section forming a collector 24 for collecting light from a light source, such as an LED, and a second section forming a light pipe 26 for transmitting the collected light in a more focused and/or specific direction away from the collector 24. The collector 24 has a generally cylindrical body having an axis directed generally horizontally, that is, parallel with the plane of the base plate 12, and includes a receiver 28 (best seen in FIGS. 4 and 6) for receiving an LED within the body. The receiver 28 is in the form of a recess into a bottom side of the collector 24, preferably located axially in the center of the cylindrical body. The recess of the receiver 28 in this arrangement has an inner surface in the shape of a hemisphere or spherical section; however, the receiver 28 may have other shapes suitable to receive an LED and/or primary optic therein. The light pipe 26 extends upwardly from the collector 24 and has a proximal end 30 connected to a tangential surface of the collector 24 and a distal end 32. The light pipe 26 in this arrangement has a flared shape that flares outwardly from the proximal end 30 toward the distal end 32. Preferably, the light pipe 26 is shaped such that light collected by the collector 24 at the receiver 28 is transmitted from the proximal end 30 out through the distal end 32 by means of total internal reflection along the outer surfaces of the light pipe. Thus, light from an LED disposed in the receiver 28 is collected by the collector 24 and transmitted out through the distal end 32 of the light pipe 26, thereby providing a stream of light that is directed and/or focused in a more precise direction than would be provided by the LED alone. Preferably, although not necessarily, the light pipe 26 is shaped so as to collimate the light. Further, the exterior surfaces of the light pipe 26 and/or the collector 24 are shaped such that transmission of the light is performed without requiring any additional reflective coating to be disposed on the outer surfaces of the optic 14. In this example, each of the left side and the right side and a rear side of the optic is tapered along a curve, such as along a parabolic curve, from a widest shape at the distal end of the light pipe 26 to a narrowest shape at the bottom surface of the collector 24. Further, a front side surface of the light pipe 26 is flat and extends vertically up approximately at a tangent from the cylindrical body of the collector 24. However, the optic 14 is not limited to the specific shape of the exemplary arrangement of the drawings, but may take almost any shape desired for a particular desired light transmitting and/or focusing effect. Further, although each optic 14 in the optic panel 10 is shown as having an identical shape, it may be desired and/or possible to provide an optic panel 10 with two or more different shaped optics 14.

Each optic 14 is secured in a fixed position relative to the base plate 12 by the corresponding supports 18. In this exemplary arrangement, each optic 14 is supported by 3 such supports, 18*a*, 18*b*, and 18*c*; however, more or fewer supports could be used. The support 18*a* is disposed on the rear side of the light pipe 26, the support 18*b* is disposed on the left side of the light pipe, and the support 18*c* is disposed on the right side of the light pipe. Each support 18 has the form of a tower, which in this example has the shape of a rectangular column, extending from a bottom end 34 to a top end 36. The bottom end 34 is coupled to the base plate 12, and the top end 36 is coupled to the upper exterior side edge of the light pipe 26 at the distal end 32. Each support 18 is arranged substantially perpendicular to the plane of the base plate 12; however, the supports could be tapered and/or angled, either toward or away from the respective optic 14. As best seen in FIGS. 3-5 and 7, each support 18 engages the light pipe 26 at only a single contact point 20, and a gap 22 is disposed between each support 18 and all of the remaining portions of the respective optic 14. Preferably, the support 18 approaches and engages the very distal tangential surface of the light pipe 26. In this way, the vast majority of the exterior surface of the light pipe 26 is uninterrupted by the supports 18, which allows the total internal reflection surfaces of the light pipe to be uninterrupted, thus providing for a more optimal light focusing and/or guiding surface. In this example, the exterior surface of each of the left, right, and front sides of the light pipe 26 tapers inwardly from the distal end 32 of the light pipe 26 toward the proximal end 30, forming a smoothly curved surface, such as a section of a parabolic curve. Thus, the gaps 22 are disposed between each respective support 18 and the exterior surface of the light pipe 26 below the respective point of contact 20 disposed at the very upper exterior edge of the light pipe 26 at the distal end 32.

The arrangement and shapes of the optics 14 and the supports 18 and the base plate 12 are preferably selected so that the entire optics plate 10 can be manufactured by relatively simple well-known two-part, two-stroke molding techniques. Thus, as best seen in FIGS. 2 and 6, the inner peripheral edge of each cut out 16 entirely encompasses the footprint, i.e., the vertical projection perpendicular to the plane of the base plate 12, of the respective optic 14 disposed therein. Further, the footprint of each of the supports 18 is also encompassed within and/or forms a portion of the inner peripheral edge of the respective cut out 16; however, in other arrangements, at least portions of the footprints of the supports 18 could be at least partially disposed outside of the inner peripheral edge of the respective cut out 16. In addition, all of the surfaces of the optics 14 and the supports 18 are either aligned vertically or slanted such that all upper surfaces of the optic are visible along a vertical line from above the base plate 12, and all lower surfaces of the optic are visible along a vertical line from below the base plate 12. In other words, none of the surfaces of the optics 14 or any of the supports 18 form an undercut that would form a surface that would not be directly accessible by a mold part moving in a vertical direction downwardly from above the base plate 12 or upwardly from below the base plate 12, respectively.

Each optic 14 may also optionally be connected to the base plate 12 at other locations not along the surfaces of the light pipe 26. In the present example, a front bottom edge 40 of the collector 24 is coupled to the base plate 12 along the edge of the respective cut out 16. However, in other arrangements, different or no additional connections between the collector 24 and the base plate 12 may be used to provide additional stability to the optic relative to the base plate 12.

Optionally, one or more feet 42 may be disposed on the bottom side of the base plate 12. The feet 42 may be in the form of small knobs or other projections extending downwardly from the bottom surface of the base plate 12. The feet 42 may act as spacers to maintain a preferred space between the bottom surface of the base plate 12 and, for example, a support surface for the LEDs. In other arrangements, the feet 42 may act as guides for locating the optic panel 10 in a specific desired position over the LEDs.

Preferably, the optic panel 10 is formed of polycarbonate and is molded as a single monolithic mass. However, the optic panel 10 may be formed of other materials, such as glass or other types of plastic, suitable for use as optics in the various manners described herein. Further, although the optic panel 10 is particularly useful for being molded as a single monolithic mass by a relatively simple two-mold, two-stroke molding process, the optic panel 10 may be formed by any other method capable of providing the same arrangement of features. Further, the optic panel 10 does not necessarily need to be a single monolithic mass, but rather could be assembled from individual parts that are subsequently coupled together by any suitable coupling mechanisms.

Without the inclusion of the supports 18, it was found by the applicants that satisfactory formation of the complex shape of the optic 14, and in particular formation of the upwardly extending light pipe 26, was difficult to achieve in a simple molding process. In particular, the stability of the light pipe 26 relative to the collector 24 and the base plate 12 was hard to maintain. On the other hand, the outer surfaces of the light pipe 26 are preferably uninterrupted in order to optimize the desired total internal reflection characteristics of the light pipe 26. By adding the supports 18 as described herein, the stability of the light pipe section 26 relative to the base plate 12 is improved without substantially interfering with the desired total internal reflection characteristics of the light pipe 26.

Figure 8:
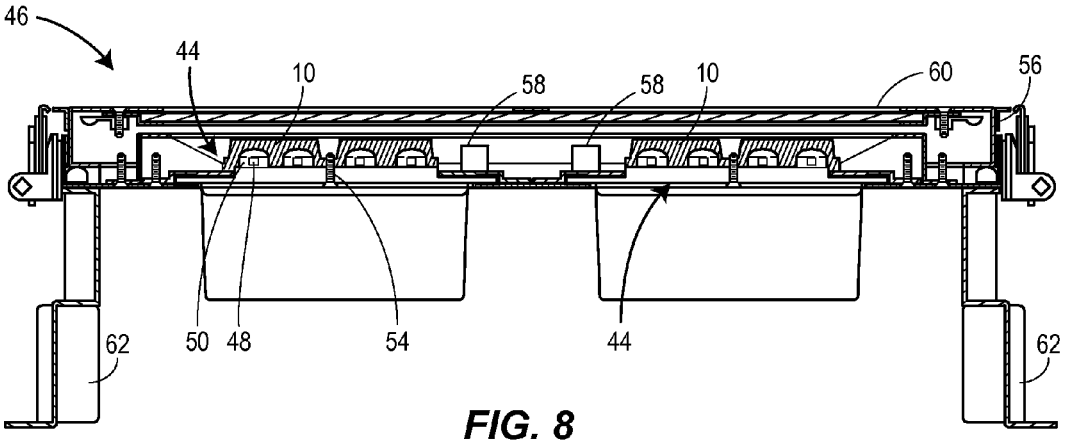
FIG. 8 is a cross-sectional view of a luminaire having a lighting system including the optic panel of FIG. 1.

Turning now to FIG. 8, an LED lighting system 44 that incorporates the optic panel 10 is illustrated. In this example, the LED lighting system 44 is incorporated as part of a luminaire 46; however, the LED lighting system 44 could be incorporated into other types of lighting systems. The LED lighting system 44 includes LEDs (light-emitting diodes) 48 and primary optics 50, which cover and are attached to the semiconductor elements of the LEDs 48 as part of a single LED light package. The primary optics 50 receive light emitted by the respective LEDs 48 and transmits that light in a more focused manner, in any manner understood in the art. The LED lighting system 44 further includes the optic panel 10 installed over the primary optics 50 such that the optics 14 function as a secondary optic, which receives the light emitted from the primary optics 50 and further directs and/or focuses the light outwardly. Thus, the optic panel 10 is disposed over the LEDs 48 such that an LED 48 and/or the associated primary optic 50 is disposed inside of one of the receivers 28 of the optic panel 10. Thus, the optic panel 10 forms a secondary optic that covers the primary optics 50.

Preferably, the optic panel 10 is coupled to the LEDs 48 and/or to a support surface for the LEDs 48 in order to fix and maintain the optics 14 (i.e., the secondary optics) in any desired fixed position over the LEDs 48 and the primary optics 50. In the exemplary arrangement of the drawings, an aperture 52 through the base plate 12 is adapted to receive a fastener, such as a screw 54, for fastening the optic panel 10 to the LEDs 48 and/or the support surface therefor. However, the optic panel 10 may be secured over the LEDs 48 in other manners, such as with adhesive, clamps, and/or other types of fasteners.

The luminaire 46, in which one or more of the LED lighting systems 44 is incorporated, includes a housing 56 and other various power, driving, and/or distribution devices. The LED lighting system 44 is carried by the housing 56. Preferably, the housing 56 defines an interior space that receives the LED lighting system 44. The luminaire 46 also includes one or more drivers 58 for driving the one or more LED lighting systems 44 from an electrical power source (not illustrated), such as a standard household or industrial AC or DC electrical power source. Preferably, the drivers 58 are also disposed within the interior space of the housing 56. Additional power, driving, control, and/or distribution devices may also be carried by and/or disposed within the interior space of the housing 56. Optionally, tertiary optics 60, such as a light diffuser panel, may be carried by the housing 56 so as to cover the optic panels 10 and/or enclose the LED lighting systems 44 within the housing 56. The luminaire 46 may further include one or more brackets 62 coupled to the housing 56 and adapted for mounting the luminaire to a support surface, such as a wall or a ceiling. The luminaire 46 may include additional features if desired. Preferably, however, the luminaire 46 is assembled and/or arranged as a single unit for ease of transportation and/or installation.

Figure 9:
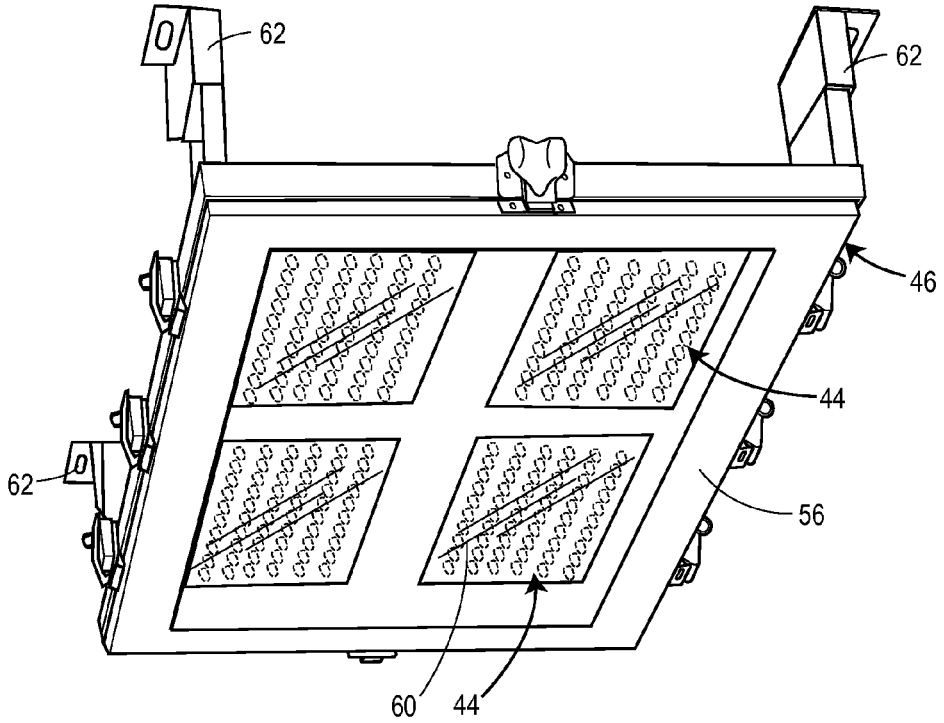
FIG. 9 is an isometric view of a luminaire according to a first arrangement.
Figure 10:
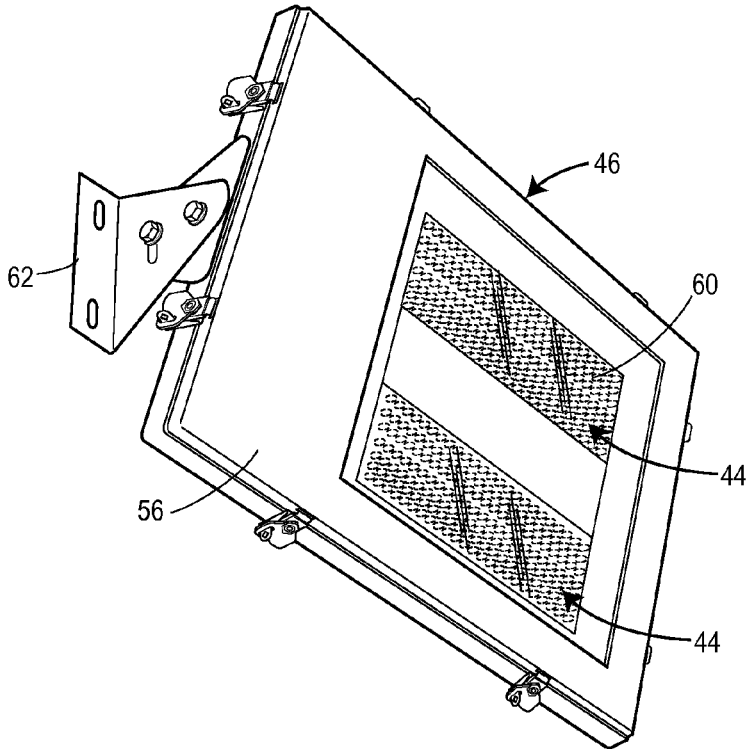
FIG. 10 is an isometric view of a luminaire according to another arrangement.

Turning now to FIGS. 9 and 10, two exemplary different styles of luminaires are illustrated for which the luminaire 46 may be adapted for use. FIG. 9 illustrates the luminaire 46 adapted for attachment to a ceiling, such as the ceiling of a tunnel or of a parking garage, to shine light from the LED lighting systems 44 generally straight downwardly onto a driving surface directly below the ceiling. In this arrangement, the luminaire 46 includes four brackets 62 extending upwardly from the housing 56, and the LED lighting systems 44 are arranged such that the light pipes 26 are directed downwardly so that light from the LEDs 48 is directed downwardly toward the driving surface without causing excessive glare directed into the eyes of drivers along the driving surface. FIG. 10 illustrates the luminaire 46 adapted for attachment to a wall, such as the wall of a tunnel or adjacent a parking lot surface, to shine light from the LED lighting systems 44 at an angle downwardly onto an adjacent driving surface. In this arrangement, the luminaire 46 includes two brackets 62 extending at an angle from the housing 56, and the LED lighting systems 44 are arranged such that the light pipes 26 are directed at an angle downwardly so that light from the LEDs 48 is directed at a downward angle toward the driving surface without causing excessive glare directed into the eyes of drivers along the driving surface outside of the angle along which the light pipes are directed. Naturally, other arrangements and uses of the luminaire 46, the LED lighting system 44, and the optic panel 10 are possible, and the arrangements illustrated and described herein are but exemplary of the many different arrangements and uses that are possible.

This detailed description is to be construed as examples only and does not describe every possible embodiment, as describing every possible embodiment would be impractical, if not impossible. One could implement numerous alternate embodiments, using either current technology or technology developed after the filing date of this application.

We claim:

1. A luminaire, comprising
- a housing;
- an LED lighting system carried by the housing; and
- a driver to drive the LED lighting system from an electrical power source;
- wherein the LED lighting system further comprises:
- a light emitting diode;
- a primary optic coupled to the light emitting diode to receive and transmit light from the light emitting diode; and
- a secondary optic panel having a secondary optic that covers the primary optic to receive light transmitted from the primary optic and transmit the light, wherein the secondary optic panel comprises:
  - a base plate having a cutout, wherein the base plate fixes the secondary optic over the primary optic;
  - the secondary optic disposed in the cutout and coupled to the base plate, the secondary optic comprising a collector and a light pipe extending upwardly from the collector, wherein the light pipe has a distal end spaced from the collector, and light collected by the collector is focused outwardly by the light pipe; and
  - a plurality of supports, each support extending from the base plate to the light pipe, wherein the supports fix the secondary optic to the base plate;
  - wherein each support engages the light pipe at only a single contact point and a gap is disposed between the support and all other portions of the secondary optic.

2. The luminaire of claim 1, further comprising a plurality of brackets adapted to hang the luminaire from a ceiling such that light emitted by the secondary optic is directed straight downwardly and reduces glare at an angle from the luminaire.

3. The luminaire of claim 1, further comprising a plurality of brackets adapted to hang the luminaire from a wall such that light emitted by the secondary optic is directed downwardly at an angle and reduces glare and points outside of the angle.

4. The luminaire of claim 1, wherein the single contact point is located at the distal end of the light pipe.

5. The luminaire of claim 1, wherein the cutout encompasses the downward projection of the secondary optic.

6. The luminaire of claim 1, wherein the collector includes a receiver for receiving light transmitted from the primary optic, and wherein light received by the receiver is guided within the collector and the light pipe by total internal reflection to exit the distal end of the light pipe.

7. The luminaire of claim 6, wherein the light pipe is a collimator that culminates the light received from the receiver.

8. The luminaire of claim 1, wherein each support is in the form of a tower having a bottom end and a top end, wherein the bottom end is coupled to the base plate, and the top end is coupled to a distal end of the light pipe.

9. The luminaire of claim 8, wherein the secondary optic tapers inwardly from the distal end of the light pipe toward the collector, and wherein the gap is disposed between each tower and the light pipe below the single point of contact such that internally reflected light within the light pipe is not able to pass into the towers at any location except at the single point of contact.

10. The luminaire of claim 8, wherein the base plate, the secondary optic, and the towers are formed of a single, monolithic piece of material.

11. The luminaire of claim 10, wherein the material is polycarbonate.

12. The luminaire of claim 1, wherein no additional reflective material is disposed on the secondary optic.

13. The luminaire of claim 1, wherein the secondary optic panel is fixedly coupled with the light emitting diode.

14. The luminaire of claim 13, wherein the base plate includes an aperture, and a fastener is disposed through the aperture and fixedly couples the base plate with the light emitting diode.

15. The luminaire of claim 1, wherein the LED lighting system further comprises a plurality of the light emitting diodes and a corresponding plurality of the primary optics, and wherein the secondary optic panel further comprises a corresponding plurality of the cutouts through the base plate and a corresponding plurality of the secondary optics, wherein one of the primary optics is coupled to a corresponding one of each of the light emitting diodes, one of the secondary optics covers a corresponding one of each of the primary optics, one of the secondary optics is disposed in a corresponding one of each of the cutouts, and each of the secondary optics is fixed to the base plate by a corresponding plurality of the supports.

16. The luminaire of claim 1, further comprising a plurality of LED lighting systems and a plurality of drivers, wherein one of the drivers drives a corresponding one of the LED lighting systems.

17. The luminaire of claim 1, further comprising a light diffuser panel carried by the housing, wherein the light diffuser panel encloses the LED lighting system within the housing.

18. A method of manufacturing a luminaire, comprising:

assembling an LED lighting system; and fixing the LED lighting system and a driver to drive the LED lighting system within a housing;

wherein assembling an LED lighting system comprises:

fixing a light emitting diode with a primary optic, the primary optic covering the light emitting diode and configured such that the primary optic receives and transmits light from the light emitting diode;

assembling a secondary optic panel comprising a secondary optic; and covering the primary optic with the secondary optic such that the secondary optic receives and transmits the light from the primary optic;

wherein assembling the secondary optic panel comprises:

cutting a cutout from a base plate;

disposing in the cutout the secondary optic, the secondary optic comprising a collector and a light pipe extending upwardly from the collector, wherein the light pipe has a distal end spaced from the collector, and light collected by the collector is focused outwardly by the light pipe; and fixing the secondary optic to the base plate using a plurality of supports, each support extending from the base plate to the light pipe, wherein fixing the secondary optic to the base plate comprises engaging the light pipe with the support at only a single contact point such that a gap is disposed between the support and all other portions of the secondary optic.

19. The method of claim 18, further comprising:

fixedly coupling the secondary optic panel with the light emitting diode, and fixedly coupling the base plate with the light emitting diode.

20. The method of claim 18, further comprising mounting a plurality of brackets to the housing adapted to hang the luminaire from a ceiling or a wall.

* * * * *